US010544654B2

(12) United States Patent
Bjørgum et al.

(10) Patent No.: US 10,544,654 B2
(45) Date of Patent: Jan. 28, 2020

(54) WELL TOOL DEVICE WITH A FRANGIBLE DISC

(71) Applicant: Vosstech AS, Voss (NO)

(72) Inventors: Stig Ove Bjørgum, Voss (NO); Espen Hiorth, Trondheim (NO)

(73) Assignee: Vosstech AS, Voss (NO)

( * ) Notice: Subject to any disclaimer, the term of this patent is extended or adjusted under 35 U.S.C. 154(b) by 0 days.

(21) Appl. No.: 16/072,984

(22) PCT Filed: Feb. 10, 2017

(86) PCT No.: PCT/EP2017/052994

§ 371 (c)(1),
(2) Date: Jul. 26, 2018

(87) PCT Pub. No.: WO2017/137559

PCT Pub. Date: Aug. 17, 2017

(65) Prior Publication Data

US 2019/0032448 A1 Jan. 31, 2019

(30) Foreign Application Priority Data

Feb. 12, 2016 (NO) ..... 20160249

(51) Int. Cl.
*E21B 34/06* (2006.01)
*E21B 33/12* (2006.01)
*E21B 33/134* (2006.01)

(52) U.S. Cl.
CPC ..... *E21B 34/063* (2013.01); *E21B 33/1204* (2013.01); *E21B 33/1208* (2013.01); *E21B 33/134* (2013.01)

(58) Field of Classification Search
CPC ..... E21B 33/1204; E21B 33/1208; E21B 33/134; E21B 34/063
See application file for complete search history.

(56) References Cited

U.S. PATENT DOCUMENTS 7,909,104 B2 3/2011 Bjorgum
2002/0136904 A1 9/2002 Glass et al.
(Continued)

FOREIGN PATENT DOCUMENTS

NO 321976 B1 7/2006
NO 20130427 A1 3/2014
(Continued)

OTHER PUBLICATIONS

International Search Report issued in PCT/EP2017/052994 dated Apr. 25, 2017 (6 pages).
(Continued)

*Primary Examiner* — James G Sayre
(74) *Attorney, Agent, or Firm* — Osha Liang LLP

(57) ABSTRACT

A well tool device may include a housing having an inner surface defining a through bore. Additionally, the well tool device may include a frangible disc including an upper chamfered supporting surface and a lower chamfered supporting surface and is supported by a seat in relation to the housing. Further, a force transmitting device is provided between the frangible disc and the seat. The force transmitting device may include an upper contact ring provided between the upper chamfered supporting surface of the frangible disc and the seat and a lower contact ring provided between the lower chamfered supporting surface of the frangible disc and the seat.

12 Claims, 6 Drawing Sheets

(56) References Cited

U.S. PATENT DOCUMENTS

| | | | |
|---|---|---|---|
| 2007/0163776 | A1 | 7/2007 | Sorensen |
| 2011/0000676 | A1 | 1/2011 | Brandsdal |
| 2012/0125631 | A1 | 5/2012 | Entchev et al. |

FOREIGN PATENT DOCUMENTS

| | | | | |
|---|---|---|---|---|
| WO | 2014/148914 | A2 | 9/2014 | |
| WO | 2014/154464 | A2 | 10/2014 | |
| WO | WO-2014154464 | A3 * | 3/2015 | ..... E21B 33/1208 |

OTHER PUBLICATIONS

Written Opinion of the International Searching Authority issued in PCT/EP2017/052994 dated Apr. 25, 2017 (8 pages).
Norwegian Search Report issued in NO 20160249 dated Sep. 13, 2016 (2 pages).

* cited by examiner

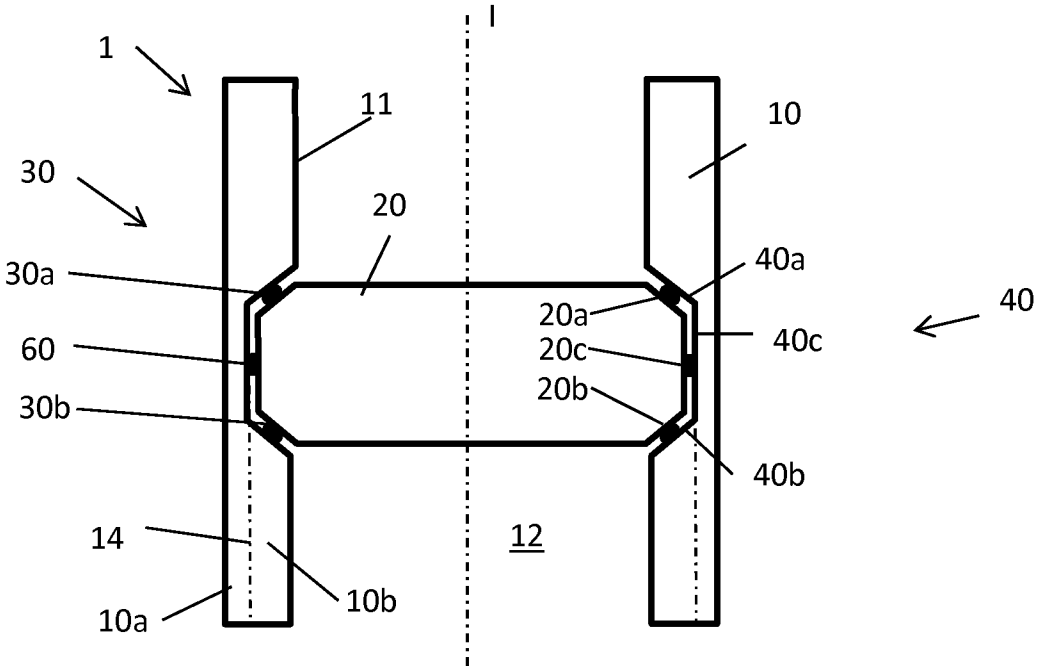
Fig. 1: Prior art

WELL TOOL DEVICE WITH A FRANGIBLE DISC

FIELD OF THE INVENTION

The present invention relates to a well tool device with a frangible disc.

BACKGROUND OF THE INVENTION

Frangible well plugs are commonly used in tools for oil and/or gas wells. These plugs provide a pressure barrier in the tool, for example during periodic or permanent isolation of zones in the well, during well integrity testing, etc.

These frangible well plugs have a frangible barrier element in the form of a frangible disc made from glass, hardened glass, ceramics etc. The barrier element is provided in a seat in a metal housing. The barrier element may be removed by means of various techniques, where the purpose is to disintegrate the element into small pieces.

An example of a glass plug is known from NO 321 976 (TCO AS). The plug comprises a number of layered or stratified ring discs of a given thickness, which are placed in abutment on top of one another. Between the different layers of the plug an intermediate film of plastic, felt or paper is inserted; the various glass layers may also be joined by means of lamination by an adhesive such as a glue. During use the plug will be mounted in a plug-receiving chamber in a tubing, where the underside of the plug rests in a seat at the bottom of the chamber. An explosive charge is furthermore incorporated in the top of the plug by one or more recesses being drilled out from the top of the plug, in which recesses the explosive charge(s) are placed.

Another example is known from NO 20130427 (Vosstech AS). Here, the plug has one glass disc, which may be disintegrated by a radial pin or loading device being pushed into the glass disc.

One object of the invention is to provide a well plug with one glass disc body at higher pressure ratings.

With the above prior art well plugs, different types of seals are used between the metal and the glass. Often, one type of seal (typically o-ring) is used circumferentially around the glass disc to avoid fluid flow in the area between the glass disc and the metal housing. A second type of seal is used in the upper part and lower part of the seat to avoid contact between the glass disc and the metal housing, as is it known for the skilled person that such contact will cause an undesired breaking of the glass disc when the differential fluid pressure is increasing above a certain level. This second type of seal is often referred to as a force transmitting device, for transmitting the force applied to the glass by the fluid pressure further to the housing.

At high differential pressures above the glass disc, a relatively high force is applied by this fluid pressure onto the glass disc, where this relatively high force is transmitted to the seat of the housing. At such high pressures, the glass disc itself may be deformed slightly, increasing the risk for contact between the glass and the metal. Another object of the invention is to provide a force transmitting device which increases the possible differential pressure over the glass disc.

Today, a very high precision is necessary for the chamfered surfaces of the glass disc and the chamfered surfaces of the seat. The hardening process of the glass disc comprises heating and subsequent cooling of the glass disc, which may cause the glass disc to become slightly uneven. For some prior art application, it has been found necessary to polish the surfaces of the glass disc, a process which may damage the glass disc. Hence, one object of the invention is to reduce the need for precision of the chamfered surfaces of the glass disc and the chamfered surfaces of the seat.

SUMMARY OF THE INVENTION

The present invention relates to a well tool device comprising:

- a housing having an inner surface defining a through bore;
- a frangible disc comprising upper and lower chamfered supporting surfaces;
- a seat for supporting the frangible disc in relation to the housing;
- a force transmitting device provided between the frangible disc and the seat; characterized in that:
- the force transmitting device is comprising an upper contact ring provided between the upper chamfered supporting surface of the frangible disc and the seat;
- the force transmitting device is comprising an lower contact ring provided between the lower chamfered supporting surface of the frangible disc and the seat.

In one aspect the upper and lower contact rings are provided in contact with flexible elements.

In one aspect the flexible elements are flexible ring elements.

In one aspect the flexible elements are provided in recesses provided in the contact rings.

In one aspect the seat comprises:

- an upper supporting ring provided between the upper contact ring and the housing;
- a lower supporting ring provided between the lower contact ring and the housing.

In one aspect, flexible elements are provided axially between the upper and lower contact rings and the upper and lower supporting rings respectively.

In one aspect the upper supporting ring is comprising a chamfered supporting surface facing towards the upper chamfered supporting surface of the frangible disc and where the lower supporting ring is comprising a chamfered supporting surface facing towards the lowered chamfered supporting surface of the frangible disc.

In one aspect the recesses of the upper and lower contact rings are extending in the circumferential direction of the contact rings; and the chamfered surfaces of the supporting rings are provided in ends of respective protruding elements of the supporting rings; where the protruding elements of the supporting rings are inserted into the respective recesses of the contact rings.

In one aspect the contact rings are made of a metal or metal alloy having an E-module equal to the E-module of the material of the frangible disc plus/minus 30% of E-module of the material of the frangible disc.

In one aspect the contact rings are made of a metal or metal alloy, where the friction coefficient between the glass disc and the metal or metal alloy is 0.1 or lower.

In one aspect the contact rings are made of an metal alloy comprising:

a) nickel 14.5%-15.5% by weight;

b) zinc 7.5%-8.5% by weight;

wherein the remainder of the alloy is copper and impurities.

In one aspect the upper and lower contact ring are made of a metal or metal alloy.

The present also relates to the use of a metal alloy as a force transmitting device in a well tool device comprising a housing, a frangible disc and a seat for supporting the frangible disc in relation to the housing, where the force transmitting device is provided between the frangible disc and the seat, where the metal alloy is comprising:

a) nickel from 14.5% to 15.5% by weight b) zinc 7.5%-8.5% by weight; and c) wherein the remainder of the alloy is copper and impurities.

DETAILED DESCRIPTION

Embodiments of the invention will now be described in detail with reference to the enclosed drawings, where:

FIG. 1 illustrates a cross sectional view of a prior art well tool device with a frangible disc;

Figure 5A:
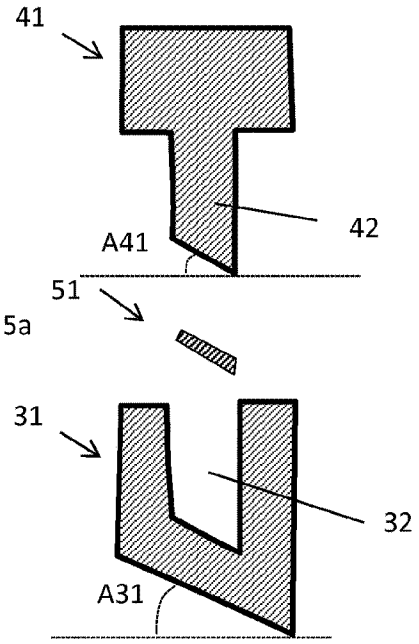
Figure 5B:
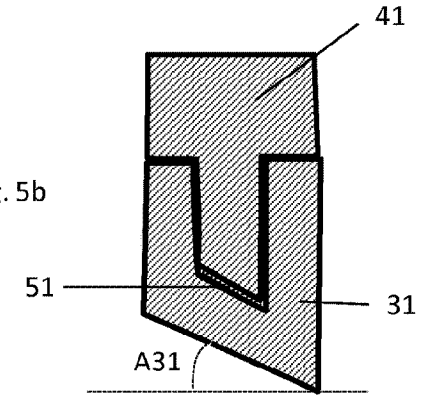
Figure 4:
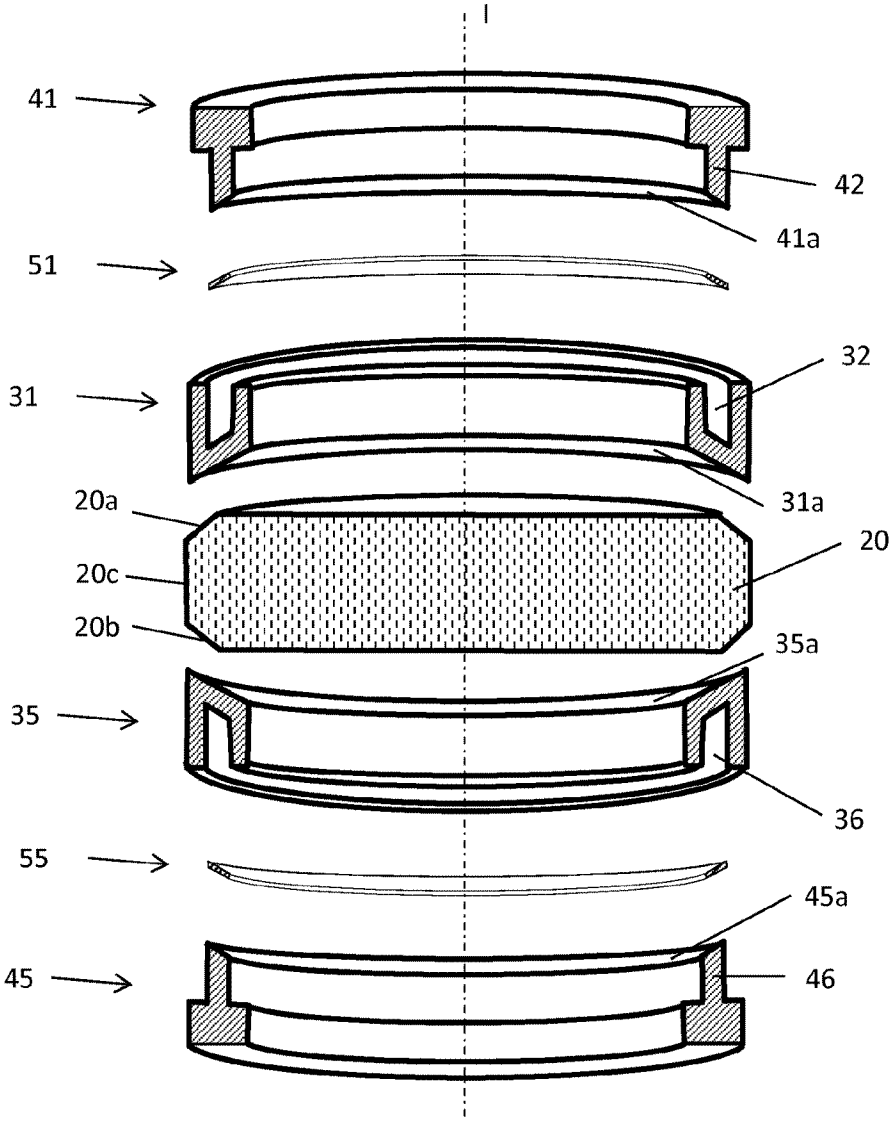
FIG. 4 illustrates an exploded cross sectional view of the frangible disc, upper and lower supporting rings and the upper and lower contact rings from the embodiment in FIG. 2.
Figure 6:
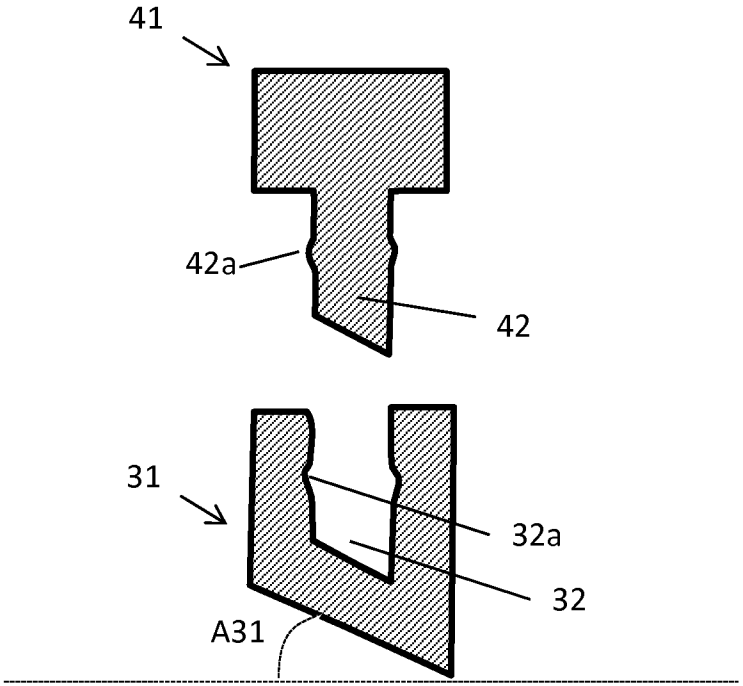
Figure 7A:
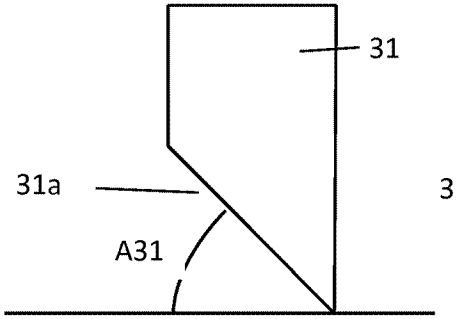
Figure 7B:
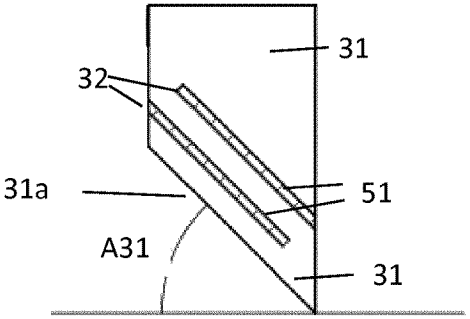

FIG. 5*a* illustrates an enlarged view of the respective cross sections of the upper supporting ring, the upper contact ring and the flexible element from FIG. 4 when separated from each other;

FIG. 5*b* illustrates that the upper supporting ring, the upper contact ring and the flexible element are assembled;

FIG. 6 illustrates an alternative embodiment of the supporting rings and the contact rings;

FIG. 7*a* illustrates a cross section of a lower part of an alternative embodiment of the upper contact ring;

FIG. 7*b* illustrates an alternative embodiment to FIG. 7*a;*

Figure 7C:
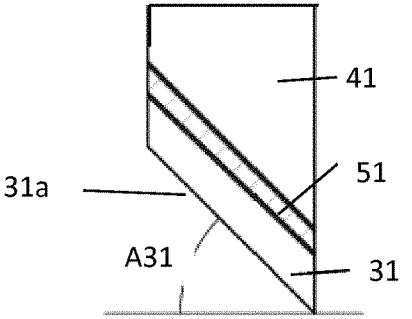
Figure 7D:
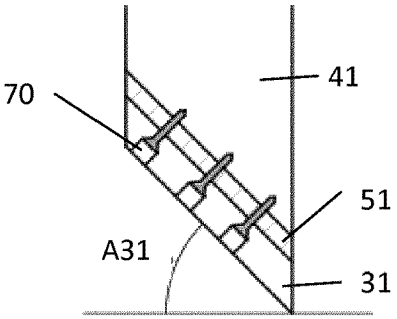
Figure 7A:
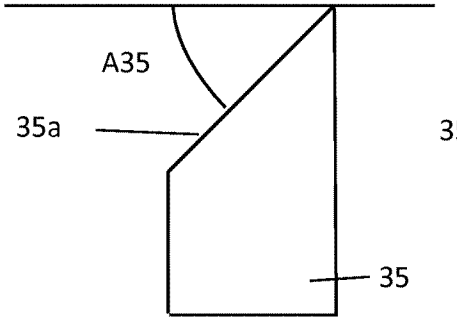
Figure 7B:
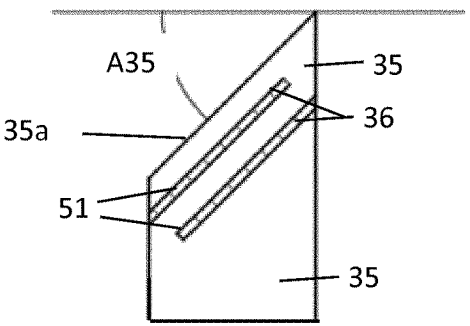
Figure 7C:
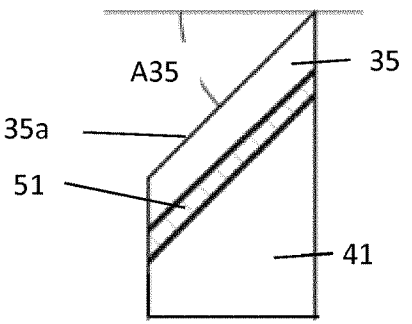
Figure 7D:
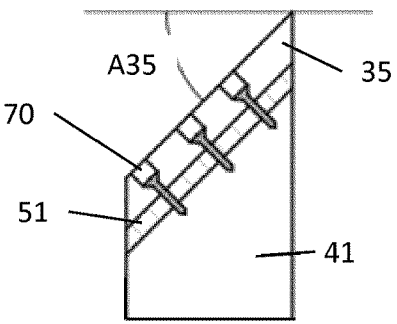

FIG. 7*c* illustrates a cross section of a lower part of an alternative embodiment of the upper contact ring and the upper supporting ring;

FIG. 7*d* illustrates an alternative to the embodiment in FIG. 7*c*.

Figure 8B:
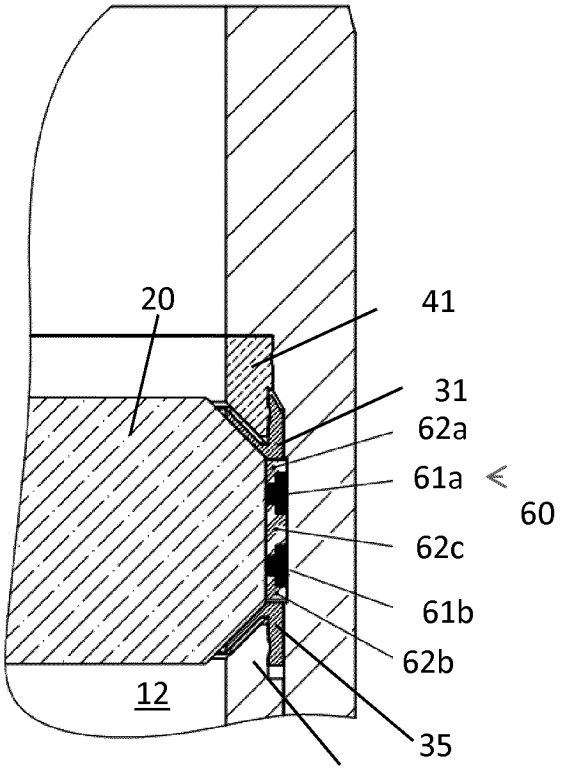
Figure 8A:
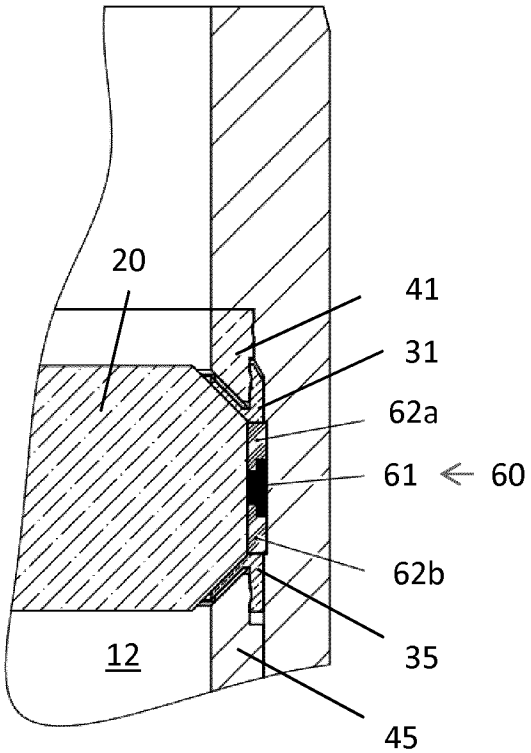

FIGS. 8*a* and 8*b* illustrates two alternative embodiments of the well tool device.

First, FIG. 1 will be described. The prior art well tool device 1 comprises a housing 1 with an inner surface 11 defining a through bore 12. A seat 40 is provided in the inner surface 11 of the housing, with an upper chamfered supporting surface 40*a*, a lower chamfered supporting surface 40*b* and a side surface 40*c* between the upper and lower chamfered supporting surfaces 40*a*, 40*b*. The side surface 40*c* is typically provided in an axial direction, i.e. parallel to the longitudinal axis I of the well tool device 1. Here, it should be noted that the seat 40 is made in the inner surface 11 of the housing 10, i.e. it is made of the same material as the housing 10, often being a high quality steel material.

A frangible disc 20 is provided in the seat 40, and comprises upper and lower chamfered supporting surfaces 20*a*, 20*b* and an axial supporting side surface 20*c*, corresponding to the surfaces of the seat 40. In the present embodiment, the frangible disc 20 is made of a hardened glass material.

In FIG. 1, a seal, generally referred to with reference number 60, are provided radially between the frangible disc 20 and the housing 10. The seal 60, typically an o-ring, is provided around the frangible disc 20 between the surfaces 20*c*, 40*c*.

In addition, the well tool device 1 in FIG. 1 comprises so-called contact-preventing seals or force transmitting devices 30*a*, 30*b* in FIG. 1.

The housing 10 typically comprises first and second housing sections 10*a*, 10*b* connected to each other via a threaded connection indicated by the dashed line 14 in FIG. 1. This is necessary for the assembly of the well tool device 1. First, the seals 30*a*, 30*b*, 60 and disc 20 are inserted into the first housing section 10*a*, then the second housing section 10*b* is connected to the first housing section 10*a*, thereby locking the seals and disc to the housing 10.

It should be noted that the term "upper" is used herein to describe the side of the well tool device 1 being closest to the topside of the well, while the term "lower" is used to describe the side of the well tool device 1 being closest to the bottom of the well, when the well tool device 1 is lowered into a oil/gas well.

Figure 3:
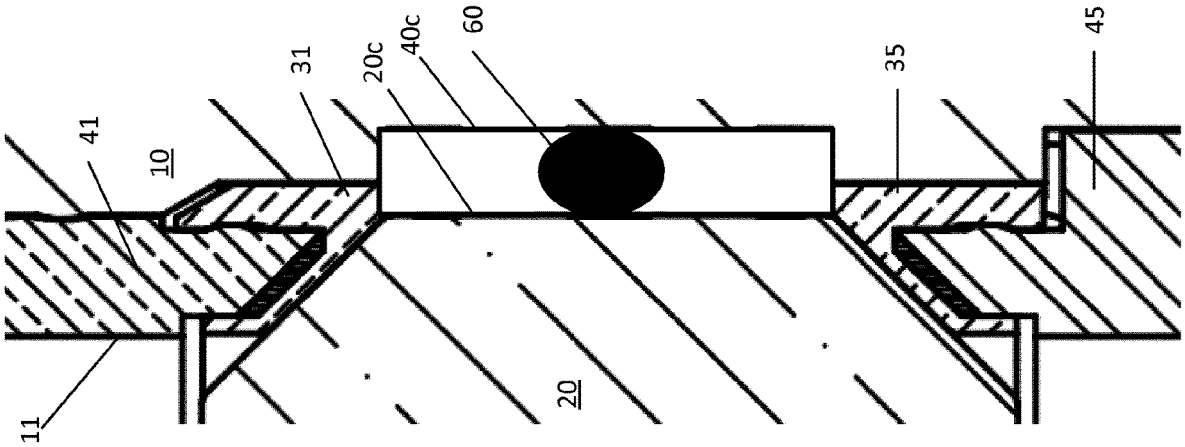
FIG. 3 is an enlarged view of detail A of FIG. 2.
Figure 2:
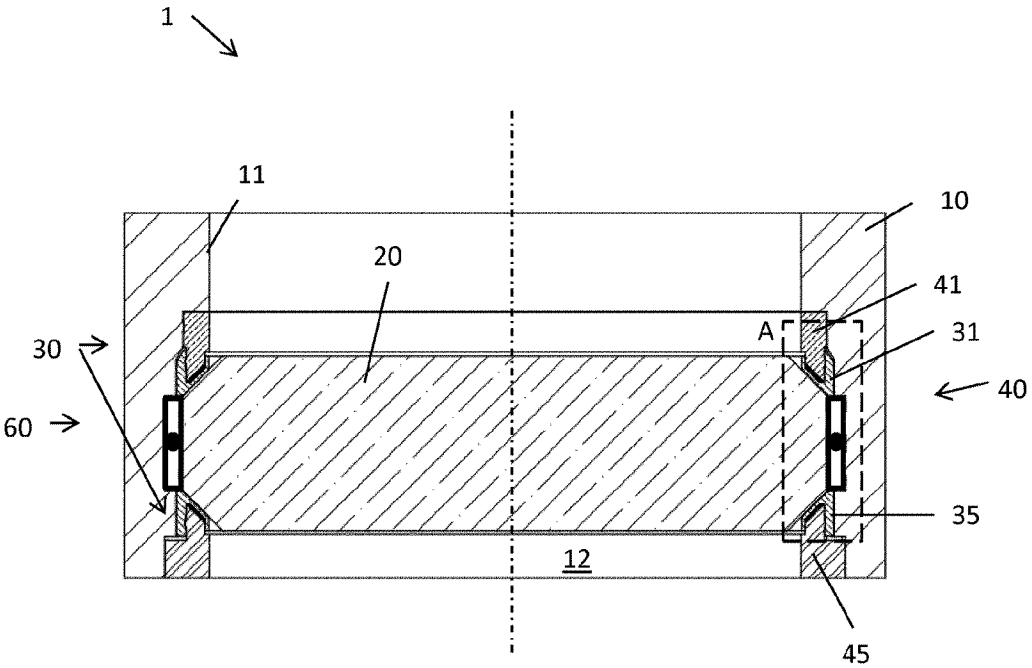
FIG. 2 illustrates a cross sectional view of a first embodiment of the well tool device.

It is now referred to FIGS. 2 and 3. Similar to FIG. 1, the well tool device 1 comprises a housing 10 having an inner surface 11 defining a through bore 12, a frangible disc 20 and a seat 40. As in the prior art, the seat 40 is provided for supporting the frangible disc 20 in relation to the housing 10. There is also a sealing device generally referred to with reference number 60 provided radially between the frangible disc 20 and the seat 40.

It should be noted that the frangible disc 20 may have various shapes; the glass disc may for example be a glass object with convex surfaces.

In FIGS. 2 and 3, it is shown that the well tool device 1 further comprises a force transmitting device 30 provided between the frangible disc 20 and the seat 40. The force transmitting device 30 is comprising an upper contact ring 31 provided between the upper chamfered supporting surface 20*a* of the frangible disc 20 and the seat 40. The force transmitting device 30 is further comprising a lower contact ring 35 provided between the lower chamfered supporting surface 20*b* of the frangible disc 20 and the seat 40.

As mentioned in the introduction, the purpose of the force transmitting device 30 is to transmit forces applied to the glass disc 20 by fluid in the bore further from the glass disc 20 to the housing 10 via the seat 40, without breaking the glass disc 20.

The seat 40 and force transmitting device 30 will now be described with reference to FIG. 4, FIGS. 5*a* and 5*b*.

The seat 40 comprises an upper supporting ring 41 and a lower supporting ring 45. The upper supporting ring 41 comprises a chamfered supporting surface 41*a* facing towards the upper chamfered supporting surface 20*a* of the frangible disc 20. The upper supporting ring 41 comprises a downwardly protruding element 42, where the chamfered surface 41*a* is provided in the lower end of the downwardly protruding element 42.

In a similar way, the lower supporting ring 45 comprises a chamfered supporting surface 45 a facing towards the lower chamfered supporting surface 20 *b* of the frangible disc 20. The lower supporting ring 45 comprises an upwardly protruding element 46, where the chamfered surface 45 a of the lower supporting ring 45 is provided in the upper end of the protruding element 46 of the supporting ring 45.

The upwardly and downwardly protruding elements 42, 46 are extending in the circumferential direction of the respective rings 41, 45.

It should be noted that the upper and lower supporting rings 41, 45 are not in contact with the frangible disc. The upper and lower supporting rings 41, 45 may for example be made of the same material as the housing 10, typically a steel material.

As shown in FIG. 5*a*, a cross section of the upper supporting ring 41 is substantially "T"-shaped. Similarly, a cross section of the lower supporting ring 45 is also substantially "T"-shaped, however, the lower supporting ring 45 is turned upside down in FIG. 4.

The force transmitting device 30 is comprising an upper contact ring 31 and a lower contact ring 35, as shown in FIG. 4. The upper contact ring 31 is provided between the chamfered surface 41*a* of the upper supporting ring 41 and the upper chamfered supporting surface 20*a* of the frangible disc 20. The lower contact ring 35 is provided between the chamfered surface 45*a* of the lower supporting ring 45 and the lower chamfered supporting surface 20*b* of the frangible disc 20. The contact rings 31, 35 are in contact with the frangible disc, more specifically, they are in contact with the chamfered surfaces of the frangible disc.

The upper contact ring 31 comprises a recess 32 extending in the circumferential direction of the contact ring 31 and the lower contact ring 35 comprises a corresponding recess 36 extending in the circumferential direction of the contact rings 35.

As shown in FIG. 5*a*, a cross section of the upper contact ring 31 is substantially "U"-shaped. Accordingly, a cross section of the lower contact ring 35 is also substantially "U"-shaped.

In the preferred embodiment, the protruding element 42 of the upper supporting ring 41 and the recess 32 of the upper contact ring 31 are configured to be engaged with each other, as shown in FIG. 5*b*. Similarly, the protruding element 46 of the lower supporting ring 45 and the recess 36 of the lower contact ring 35 are configured to be engaged with each other.

The well tool device 1 further comprises a sealing device 60 provided between the side surface 20*c* of the frangible disc 20 and the side surface 40*c* of the seat 40, as shown in FIG. 3. The side surface 40*c* of the seat 40 may here be a side surface of the housing 10. The sealing device 60 may be an O-ring or several O-rings which is considered known for a skilled person.

It is now referred to FIG. 7*a*. Here, the cross section of the contact rings 31, 35 are shown with chamfered surfaces 31*a*, 35*a* respectively. In this embodiment, there are no flexible elements 51, 55 and there are no supporting rings 41, 45. Preferably, the contact rings 31, 35 are provided directly in contact with the housing 10.

In FIG. 7*b*, recesses 32, 36 are provided in the contact rings 31, 35 respectively. The recesses 32, 36 are provided in parallel with the chamfered surfaces 31*a*, 35*a* respectively. As shown in FIG. 7*b*, flexible elements 51, 55 are provided in the recesses 32, 36 provided in the contact rings 31, 35. Accordingly, it is achieved that when a high fluid pressure is applied to the glass disc, causing the glass disc to bend slightly, the flexible ring elements 51, 55 will allow the contact rings 31, 35 to move slightly to adapt to the bended glass disc.

It is now referred to FIG. 7*c*. Here, the flexible elements 51, 55 are glued as a layer between the contact rings 31, 35 and the supporting rings 41, 45 respectively. Again, the flexible ring elements 51, 55 will allow the contact rings 31, 35 to move slightly to adapt to the bended glass disc at high pressures.

It is now referred to FIG. 7*d*, which is similar to FIG. 7*c*. Here, the contact rings 51, 55 and the flexible elements 51, 55 are connected to the supporting rings 41, 45 respectively, by means of connection devices 70 such as screws, pins etc.

It is now referred to FIGS. 8*a* and 8*b*, which show embodiments of a well tool device 1 similar to the one shown in FIG. 2. In FIG. 8*a* the sealing device 60 comprises a sealing ring 61 with a T-shaped cross sectional shape. An upper filler material 62*a* is provided axially between the sealing ring 61 and the upper contact ring 31 and a lower filler material 62*b* are provided above and below the sealing ring 61. In FIG. 8*b*, the sealing device 60 comprises an upper sealing ring 61*a* and a lower sealing ring 61*b* with a T-shaped cross sectional shape. As for FIG. 8*a*, a filler material 62*a*, 62*b*, 62*c* is provided between the sealing rings 61*a*, 61*b* and the upper and lower contact rings 31, 35.

Preferably, the contact rings 31, 35 are made of a metal or metal alloy having an E-module equal to the E-module of the material of the frangible disc 20 plus/minus 30% of E-module of the material of the frangible disc 20. Moreover, the contact rings 31, 35 are preferably made of a metal or metal alloy having a low friction glass.

In the present embodiment, the contact rings 31, 35 are made of the material sold under the name ToughMet 3 by Materion Corporation. This material is a metal alloy comprising a) 14.5%-15.5% Ni by weight;

b) 7.5%-8.5% Sn by weight;

c) 76.0%-78.0% Cu by weight;

wherein the remainder of the alloy is copper and impurities. Accordingly, the material is a copper alloy as defined by UNS C 72900.

It is now referred to FIG. 4, FIGS. 5*a* and 5*b*. Here it is shown that a upper flexible ring element 51 is provided between the chamfered surface 41*a* of the upper supporting ring 41 and the recess 32 of the upper contact ring 31. Similarly, a lower flexible ring element 55 is provided between the chamfered surface 45*a* of the lower supporting ring 45 and the recess 36 of the lower contact ring 35.

As a high differential pressure over the frangible disc will bend the frangible disc slightly, the flexible ring elements 51, 55 will allow the contact rings 31, 35 to move slightly together with the frangible disc in relation to the supporting rings 41, 45.

As mentioned in the introduction below, it has previously not been known that a metal or metal alloy could be used in contact with such a frangible disc in a well tool device 1. Accordingly, the present invention is also related to the use the above metal alloy as a sealing device 30 in a well tool device 1 comprising a housing 10, a frangible disc 20 and a seat 40 for supporting the frangible disc 20 in relation to the housing 10, where the sealing device 30 is provided between the frangible disc 20 and the seat 40.

It is now referred to FIG. 6. Here, the protruding element 42 of the supporting rings 41 comprises a connection element 42 *a* configured for engagement with a corresponding connection element 32 *a* provided in the recess 32 of the contact ring 31. Similar connection elements may be provided on the lower supporting ring 45 and the lower contact ring 31. In this way the upper rings 31, 42 (and, if present, ring 51) may be connected together as one ring unit, and the lower rings (35, 45 (and, if present, ring 55) may be connected together as another ring unit, which will simplify the assembly of the well tool device 1.

The well tool device 1 according to the present invention (disclosed in FIG. 2) has been tested according to ISO 14310 V0 up to 430 bar at a temperature of 121° C. Other tests show that the frangible disc 20 may be supported by the contact rings up to 830 bar at 150° C., without disintegration of the glass disc. Hence, it is shown that by selecting a proper type of metal or metal alloy, a glass material may actually be provided in contact with such a metal or metal alloy.

It should be noted that in prior art, the seat 40 is normally provided as a part of the housing 10 itself, i.e. the chamfered surfaces of the seat is provided by machining the housing parts. In the present invention, the chamfered surfaces of the seat 40 are provided as a part of the supporting rings 41, 45, which again are supported in the housing 10.

The well tool device 1 described herein may be a part of a plugging device, such as a bridge plug. The housing 10 will then typically be a part of the mandrel of the plugging device. The well tool device 1 may also be a part of a completion string, where the purpose of the frangible glass disc is used to pressure test the completion string, and when the frangible disc is removed in order to start the production from the well. The housing 10 will here typically be a part of the completion string. The well tool device 1 may also be a part of other well tools where a temporary barrier is needed.

The invention claimed is:

1. A well tool device comprising:

a housing having an inner surface defining a through bore;

a frangible disc comprising an upper chamfered supporting surface and a lower chamfered supporting surface;

a seat for supporting the frangible disc in relation to the housing; and a force transmitting device provided between the frangible disc and the seat;

wherein the force transmitting device comprises an upper contact ring provided between the upper chamfered supporting surface of the frangible disc and the seat, wherein the force transmitting device comprises a lower contact ring provided between the lower chamfered supporting surface of the frangible disc and the seat, and wherein the upper contact ring and the lower contact ring are provided in contact with flexible elements.

2. The well tool device according to claim 1, wherein the flexible elements are flexible ring elements.

3. The well tool device according to claim 1, wherein the flexible elements are provided in recesses provided in the upper contact ring and the lower contact ring.

4. The well tool device according to claim 1, wherein the seat comprises:

an upper supporting ring provided between the upper contact ring and the housing;

a lower supporting ring provided between the lower contact ring and the housing.

5. The well tool device according to claim 4, wherein the flexible elements are provided axially between the upper contact ring and the lower contact ring and the upper supporting ring and the lower supporting ring, respectively.

6. The well tool device according to claim 5, wherein the upper supporting ring comprises a chamfered supporting surface facing towards the upper chamfered supporting surface of the frangible disc and wherein the lower supporting ring comprises a chamfered supporting surface facing towards the lowered chamfered supporting surface of the frangible disc.

7. The well tool device according to claim 6, wherein:

recesses of the upper contact ring and the lower contact ring are extending in a circumferential direction of the upper contact ring and the lower contact ring;

the chamfered supporting surfaces of the upper supporting ring and the lower supporting ring are provided in ends of respective protruding elements of the upper supporting ring and the lower supporting ring;

wherein the protruding elements of the upper supporting ring and the lower supporting ring are inserted into the respective recesses of the upper contact ring and the lower contact ring.

8. The well tool device according to claim 1, wherein the upper contact ring and the lower contact ring are made of a metal or metal alloy having an E-module equal to an E-module of a material of the frangible disc plus/minus 30% of the E-module of the material of the frangible disc.

9. The well tool device according to claim 1, wherein the upper contact ring and the lower contact ring are made of a metal or metal alloy, wherein a friction coefficient between the glass disc and the metal or metal alloy is 0.1 or lower.

10. The well tool device according to claim 1, where the upper contact ring and the lower contact ring are made of a metal alloy comprising:

nickel 14.5%-15.5% by weight;

zinc 7.5%-8.5% by weight; and wherein a remainder of the metal alloy is copper and impurities.

11. The well tool device according to claim 1, wherein the upper contact ring and the lower contact ring are made of a metal or metal alloy.

12. Use of a metal alloy comprising:

nickel from 14.5% to 15.5% by weight zinc 7.5%-8.5% by weight; and wherein a remainder of the metal alloy is copper and impurities, wherein the metal alloy is used as a force transmitting device in a well tool device comprising a housing, a frangible disc comprising an upper chamfered supporting surface and a lower chamfered supporting surface, and a seat for supporting the frangible disc in relation to the housing, wherein the force transmitting device is provided between the frangible disc and the seat wherein the force transmitting device comprises an upper contact ring provided between the upper chamfered supporting surface of the frangible disc and the seat, wherein the force transmitting device comprises a lower contact ring provided between the lower chamfered supporting surface of the frangible disc and the seat, and wherein the upper contact ring and the lower contact ring are provided in contact with flexible elements.

* * * * *